US006014801A

United States Patent [19]

Wilcox

[11] Patent Number: 6,014,801

[45] Date of Patent: Jan. 18, 2000

[54] SWAGE FASTENING TOOL

[75] Inventor: Robert B. Wilcox, Woodstock, N.Y.

[73] Assignee: Huck International, Kingston, N.Y.

[21] Appl. No.: 09/069,105

[22] Filed: Apr. 29, 1998

[51] Int. Cl.[7] ..... B21J 15/10

[52] U.S. Cl. ..... 29/243.525; 72/391.4; 72/453.17

[58] Field of Search ..... 72/391.4, 453.17; 29/243.523, 243.524, 243.525

[56] References Cited

U.S. PATENT DOCUMENTS

| | | | |
|---|---|---|---|
| 2,053,719 | 9/1936 | Huck et al. | 218/19 |
| 2,053,720 | 9/1936 | Huck | 218/19 |
| 4,062,217 | 12/1977 | Ebbert et al. | 29/243.525 |
| 4,310,056 | 1/1982 | Olsson | 173/169 |
| 4,462,240 | 7/1984 | Yamamoto et al. | 72/391 |
| 4,517,820 | 5/1985 | Oefinger et al. | 72/391 |
| 4,580,435 | 4/1986 | Port | 29/243.525 |
| 4,587,829 | 5/1986 | Sukharevsky | 72/391 |
| 4,598,571 | 7/1986 | Oefinger | 29/243.525 |
| 5,072,501 | 12/1991 | Vincenzo | 29/243.523 |
| 5,383,262 | 1/1995 | Brown | 29/243 |
| 5,490,312 | 2/1996 | Smith | 29/243 |
| 5,500,990 | 3/1996 | Wihan | 29/243.525 |
| 5,519,927 | 5/1996 | Roessler | 29/243 |
| 5,742,989 | 4/1998 | Subotsch | 29/243.525 |

FOREIGN PATENT DOCUMENTS 295 04 316 4/1995 Germany .

*Primary Examiner*—David Jones

*Attorney, Agent, or Firm*—Pillsbury Madison & Sutro Intellectual Property Group

[57] ABSTRACT

A swage fastening tool is disclosed, the tool including damper valve concentrically positioned about a piston which displaces the fastener being swaged. The damper valve moves with the piston when the trigger structure of the tool is actuated to supply pressurized fluid to the piston, the damper valve being positioned relative to the piston and the flow path of the fluid to meter flow both to the piston during swaging and from the piston after swaging has been completed. The trigger is provided with a camming feature to create a component of a trigger movement to actuate a flow control valve in a simplified manner and a self-restoring resilient arm portion to return the trigger structure to its initial position.

22 Claims, 3 Drawing Sheets

SWAGE FASTENING TOOL

BACKGROUND OF THE INVENTION

1. Field of the Invention

The present invention relates to a swage fastening tool and in particular, to components of the tool which simplify its triggering function and provide improved valve damping characteristics.

2. Description of the Related Art

Conventional hand-held swaging tools typically include a cylindrical housing provided with an anvil at one end and a reciprocating piston movable within the housing towards and away from the anvil. The piston is provided with a coupler by which the pinshank of a swage-type fastener is gripped as it passes through the anvil. When the piston is moved away from the anvil, the collar of the fastener is drawn against the anvil and is swaged. After this occurs, the pinshank is designed to break so as to separate from the collar. The piston then reverses its direction and moves towards the anvil until it reaches a "home" position from which the swaging operation can be repeated.

The cylindrical housings of conventional hand-held swaging tools generally are joined with a handle through which fluid moves so as to selectively operate the piston in response to actuation of a trigger provided in the handle. When the trigger is actuated, a flow control valve is displaced to cause pressurized fluid to be applied to the piston to initiate the swaging operation, and when the pinshank breaks and the trigger is released, the valve operates to relieve pressure on the piston allowing it to return to its "home" position. The handle is disposed substantially perpendicular to the longitudinal axis of the piston-containing cylinder. Thus, it is necessary that means be provided to actuate a valve having a path of movement which differs up to 90° from the direction of force applied to the valve-actuating trigger.

In some prior art devices this is accomplished by the use of air piloted valves which are combined with the trigger to initiate valve movement to actuate the tool's piston. However, air piloted valves require more seals than a directly operated valve and are more expensive. Additionally, such a piloting system requires the drilling of air passages which add to the complexity and machining cost of the tool.

Other trigger-operated valve arrangements utilize a crank-slider arrangement between the trigger and the valve. This requires a precision bore in the tool which is expensive to machine. Additionally, such an arrangement adds weight to the tool and is difficult to assemble.

Another type of arrangement uses a trigger lever, a cable and a second lever to interconnect the trigger to the valve. Such a linkage involves a number of parts and significant assembly time thereby rendering the arrangement a costly one.

A further shortcoming of known swaging tools resides in the complexity of providing a damping function to absorb the shock encountered when the pinshank of the fastener breaks and the direction of piston movement reverses. This problem is addressed in conventional tools by providing a damper valve in the path of fluid flow which has one or more passages which are opened when the fluid flows in a first direction, and a passage or passages of different size which are opened when fluid flow is reversed. Such an arrangement requires the use of various parts to control the opening and closing of such passages, as well as machining and assembly considerations in incorporating such parts in the tool. Thus, such known arrangements are expensive.

SUMMARY OF THE INVENTION

The present invention provides more cost effective solutions to the problems described above.

Generally, a swage fastening tool is provided for setting a fastener including a pin and a collar by applying a relative axial force between the pin and the collar. The swage fastening tool comprises a piston-cylinder assembly and an actuation assembly. The piston-cylinder assembly comprises a housing structure having a housing chamber positioned intermediate forward and aft ends of the housing structure extending along an axial direction, a forwardly opening cylindrical cavity coaxially aligned with the housing chamber, and a passage extending radially through the housing structure. A swaging assembly is disposed in the forwardly opening cylindrical cavity and includes a plurality of jaws adapted to grip and pull a pull portion of the pin. The swaging assembly further includes a swage anvil having a swage cavity adapted to engage and swage the collar radially inwardly onto the pin in response to relative axial pull force between the jaws and the swage anvil. The piston of the piston-cylinder assembly reciprocally slides along the axial direction between a forward "home" position and a rearward position, and is operatively connected to the swaging assembly so that slidable rearward movement of the piston applies the relative axial pull force between the jaws and the swage anvil. The housing structure also accommodates a biasing member, e.g., a return spring, to urge the piston from the rearward position towards the forward home position. The actuator assembly of the swaging tool comprises a trigger housing, a trigger structure accommodated partially in the trigger housing, a pressure-control-mechanism-receiving housing defining a chamber which is filled with hydraulic fluid, and a pressure-control mechanism operatively connected to the trigger structure and movable relative to the pressure-control-mechanism-receiving housing.

In accordance with one embodiment of this invention, the trigger structure is actuated in a direction generally parallel with the longitudinal axis of the piston-cylinder assembly which houses the swaging components. The housing structure of the piston-cylinder assembly includes a camming surface engaged by the actuated trigger structure so as to create a component of trigger movement which is directed approximately 90° to the longitudinal axis of the housing structure. A self-restoring resilient arm portion of the trigger structure extends to one end of a two-position fluid control valve. When the trigger structure is actuated, the component of movement perpendicular to the axis of the housing structure is translated by the arm portion to change the operating position of the two-position fluid control valve. As this occurs, the resilient arm portion is bent so as to store potential energy in the arm portion. On release of the trigger structure, this potential energy assists in returning the trigger structure to its initial position.

In accordance with another embodiment, which may be practice in combination with the above-discussed embodiment, the damping characteristics of the tool are improved by providing the tool with an annularly configured damper valve and a hydraulic fluid-containing damper chamber disposed in coaxial, surrounding relationship with the piston. The damper valve is provided with flanges at its opposite ends and is axially disposed along a shaft at a location whereby when the trigger structure is in a non-actuated state, a substantially open passage through the housing structures communicates the damper chamber with the hydraulic fluid-containing chamber of the actuator assembly substantially unobstructed by the damper valve. When trigger structure is actuated, it moves the pressure-control mechanism to pressurize the hydraulic fluid and, consequently, hydraulic fluid is passed through the passage and into the damper chamber so that the damper valve is displaced in a direction away from the swage tool, and the piston is correspondingly moved to compress the biasing member. The displacement of the damper valve moves one of its flanges to increasingly greater coverage of the passage until the flange substantially covers the passage to thereby metering the flow of pressurized fluid to the valve.

When the pinshank breaks and the trigger structure is released, the biasing member reverses the direction of piston movement causing fluid to flow through the passage towards the hydraulic fluid-containing chamber of the actuator assembly. Continued movement of the piston towards the swage anvil displaces the damper valve whereby the passage is increasingly opened. By controlling the rate of fluid flow in this manner, the damper valve regulates the initial returning movement of the piston to prevent the shock which otherwise could be expected when the piston reverses its direction of movement following breakage of the pinshank.

These and other objects, features, and advantages of this invention will become apparent from the following detailed description when taken in conjunction with the accompanying drawings which illustrate, by way of example, the principles of this invention.

BRIEF DESCRIPTION OF THE DRAWINGS

The invention now will be described in further detail with respect to the accompanying drawings, wherein.

DETAILED DESCRIPTION OF A PREFERRED EMBODIMENT OF THE INVENTION

Figure 1:
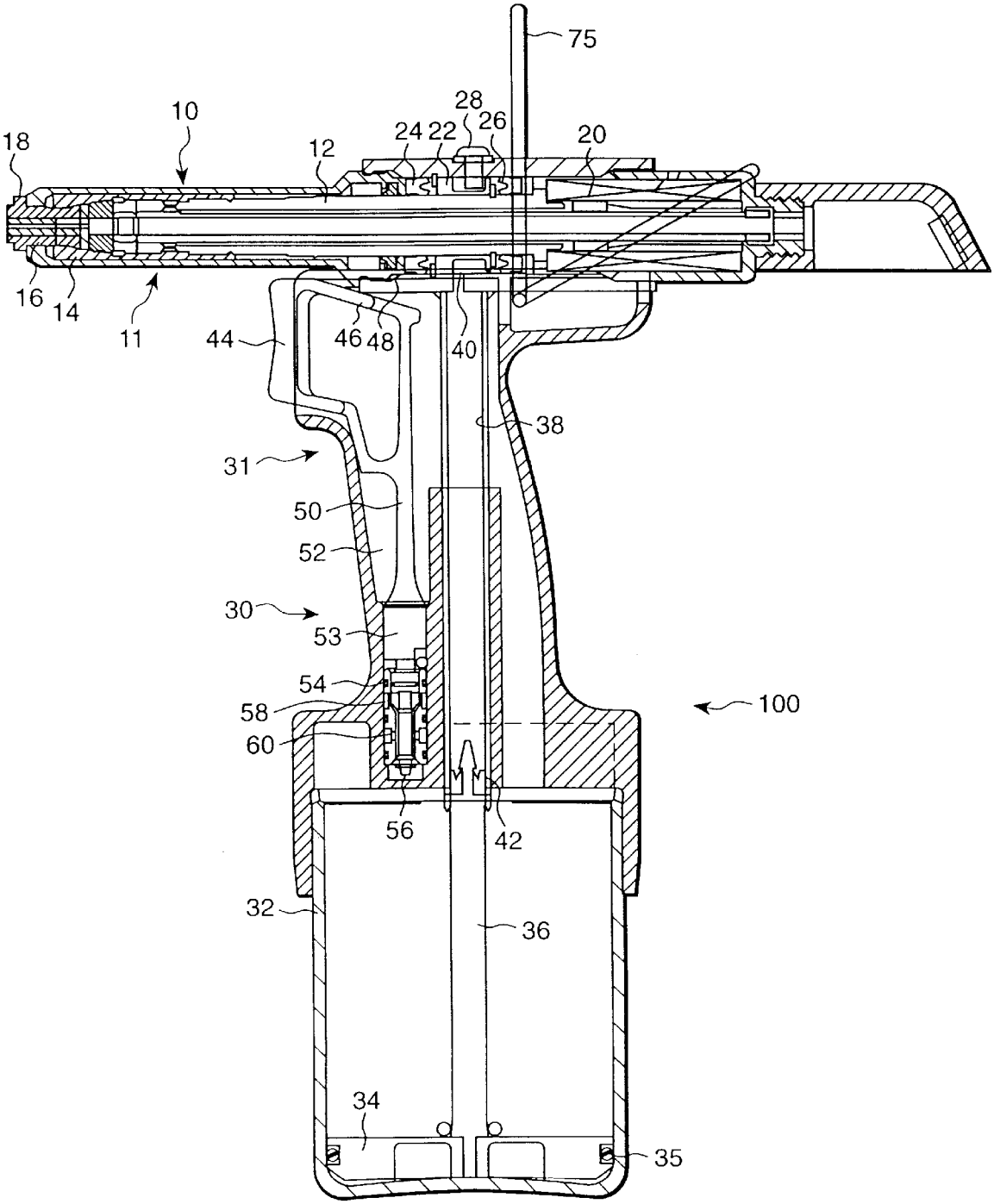
FIG. 1 is a side-elevational view, partially in section, illustrating a swage fastening tool incorporating the present invention.

Referring to FIG. 1, a swage fastening tool 100 is illustrated which includes a piston-cylinder assembly 11 comprising a generally cylindrical housing 10 within which a reciprocally movable piston 12 is located. A coupler (also referred to as a jaw assembly) 14 is jointed to one end of the piston 12 to connect the piston 12 to a breakable pinshank 16 of a fastener. The pinshank 16 passes through the central opening of an annular swage anvil 18 secured to one end of the housing structure 10. A biasing member 20, such as a spring, is positioned within the cylinder housing structure 10 at the opposite end of the piston 12, the biasing member 20 being compressed when the piston 12 is moved from the "home" position shown in FIG. 1 in a direction away from the swage anvil 18 so as to cause the collar (unnumbered) of the fastener to be swaged in conventional fashion. Following swaging and breakage of the pinshank 16, the biasing member 20 acts as a return spring to urge the piston 12 towards the swage anvil 18 to its "home" position.

A damper valve 22 also is contained within the housing structure 10 in surrounding coaxial relationship with the piston 12. The damper valve 22 is positioned between stationary cup seal 24 and movable cup seal 26 which define in part a hydraulic fluid-containing damper chamber 76. A bleed screw 28 passes through the housing structure 10 to permit hydraulic fluid to be added to, or removed from, the tool 100.

Figure 3:
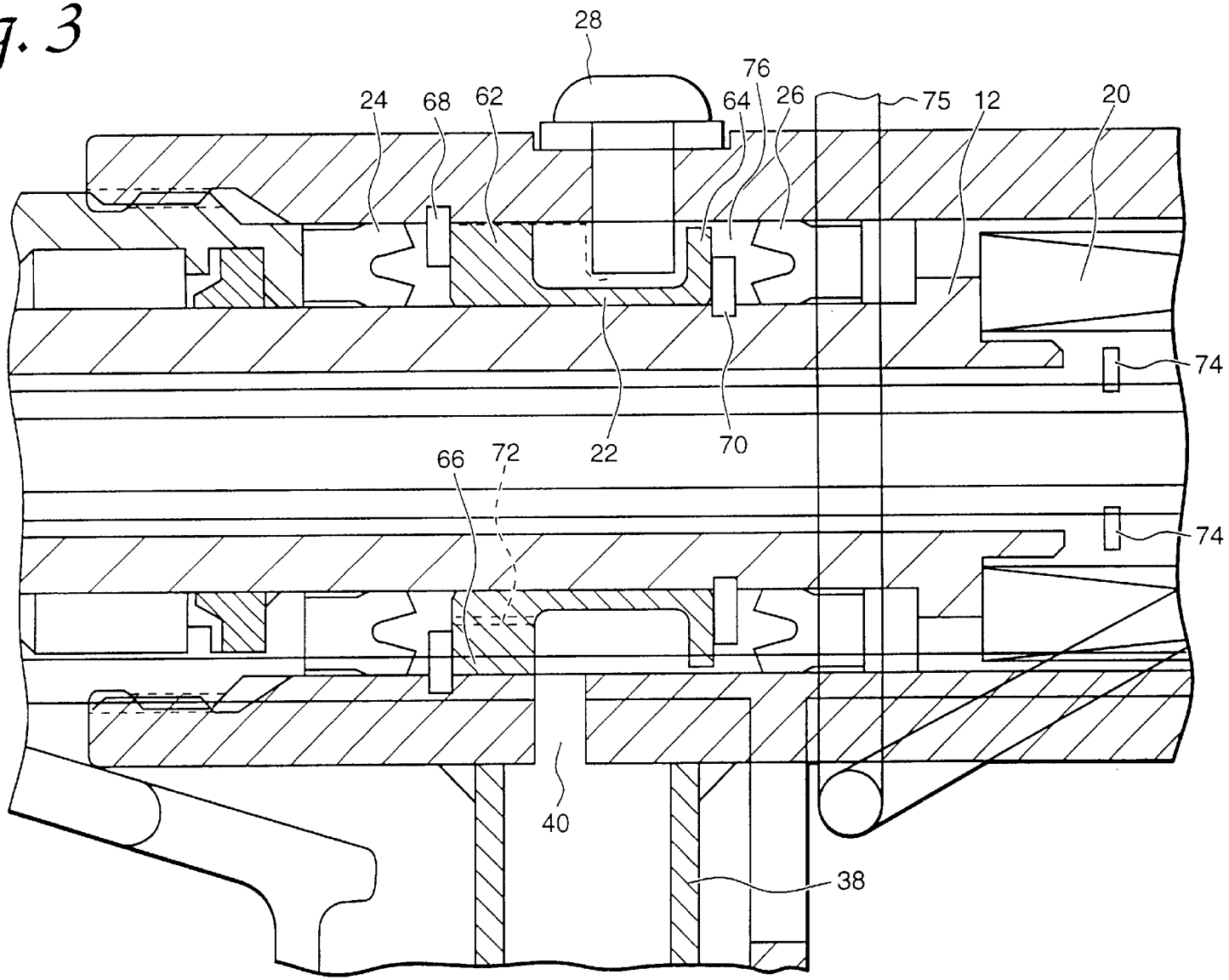
FIG. 3 is an enlarged view of a further portion of the tool shown in FIG. 1.

As shown in FIGS. 1 and 3, a hanger bracket 75 passes through the housing structure 10 facilitate balancing of the tool 100.

A handle portion 30 of an actuator assembly 31 is joined to the housing structure 10. The handle portion 30 has a principal longitudinal axis which is fixed in a substantially right angle relationship with the longitudinal axis of the housing structure 10. The handle portion 30 is provided at its free end with an air cylinder 32 within which a piston 34 is located, the piston 34 including a pressure-control mechanism (also referred to as a plunger or a rod) 36 extending through one end of a pressure-control-mechanism-receiving housing (also referred to as a tubular element) 38 within the handle portion 30. The opposite end of the tubular element 38 communicates with the interior of the housing structure 10 between cup seals 24 and 26 through an opening (also referred to as a passage) 40 in the housing structure 10. The upper end of the pressure-control mechanism 36 is provided with a seal 42 to prevent communication between the interiors of the air cylinder 32 and the tubular element 38. The damper chamber within the housing structure 10 between the seals 24 and 26, and the chamber defined by the tubular element 38 above seal 42, are filled with hydraulic fluid.

Figure 2:
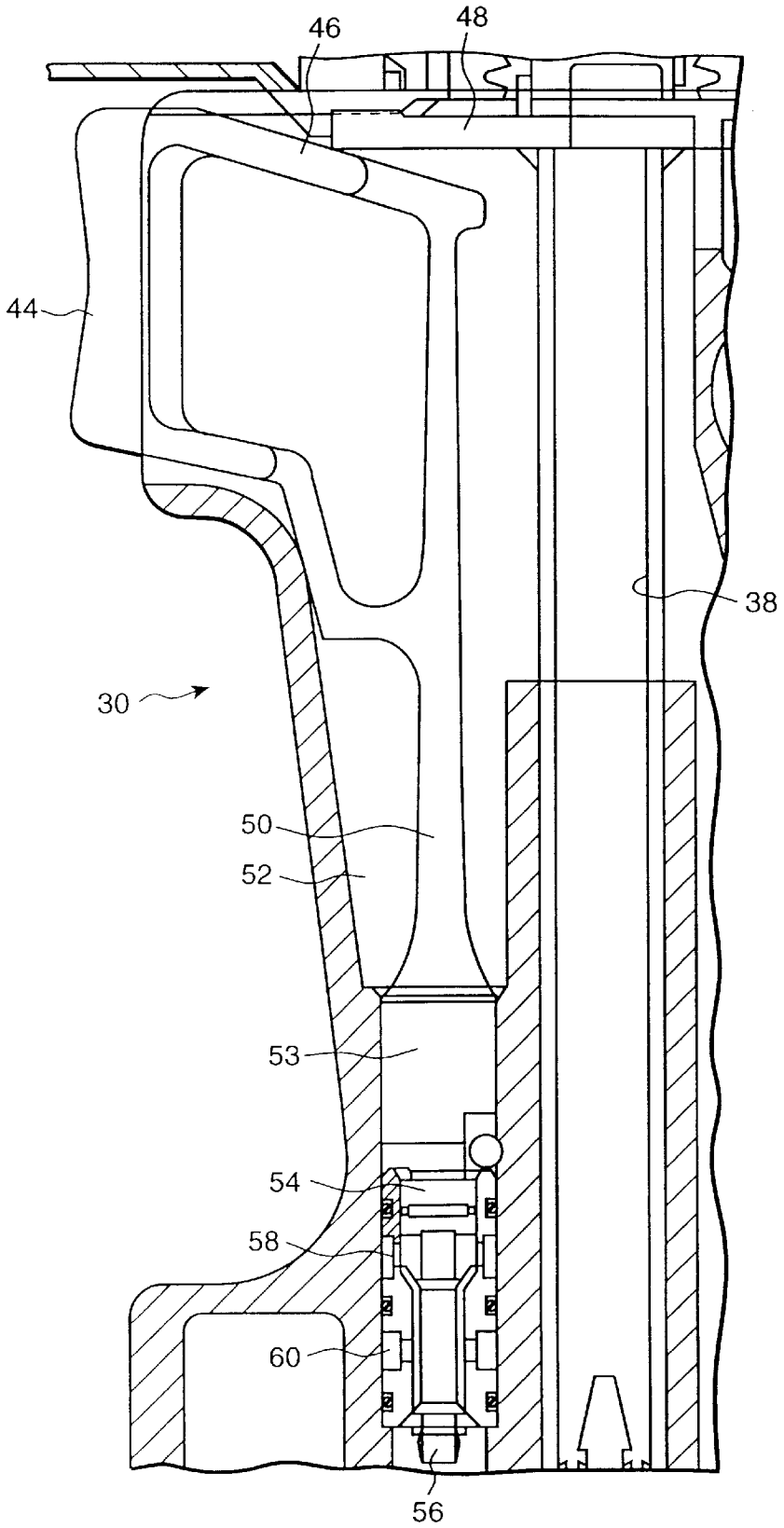
FIG. 2 is an enlarged view of a portion of the tool shown in FIG. 1.

Referring now to FIGS. 1 and 2, a trigger structure 44 is mounted in the handle portion 30. The trigger structure 44 includes an inclined portion 46 which engages a camming surface 48 secured to the housing structure 10. Thus, as the trigger structure 44 is displaced in a direction generally parallel with the longitudinal axis of the housing structure 10, a component of movement is impacted to the trigger structure 44 which is at substantially 90° to the axis of the housing structure 10. The trigger structure 44 also includes a projecting resilient arm portion 50 positioned within a channel 52 formed in the handle portion 30. At the distal end 53 of the arm portion 50, the channel 52 is formed to prevent the arm portion 50 from moving in a direction other than parallel to the principal longitudinal axis of the handle portion 30. Thus, when the trigger structure 44 is actuated, the arm portion 50 is bent as it simultaneously is moved in the direction of the axis of the handle portion 30. As a result, potential energy is stored in the arm portion 50.

A two-position valve 54 also is retained within the channel 52 below the distal end 53 of the arm portion 50. When the two-position valve 54 is in an open position shown in FIGS. 1 and 2, pressurized air supplied to a port 56 from an air source (not shown) moves along the two-position valve 54 to exhaust ports 58. However, when the trigger structure 44 is actuated, the distal end 53 of the arm portion 50 moves the two-position valve 54 to its closed position covering the exhaust ports 58 so as to direct pressurized air through ports 60 to the air cylinder 32 via an air tube (not shown) so that the pressurized air enters the air cylinder 32 below the piston 34. (For convenience of illustration, the air flow path is not shown.) This results in the piston 34 with O-ring seal 35 being displaced upwardly to thereby move the pressure-control mechanism 36 and its seal 42 along the tubular element 38 to pressurize the hydraulic fluid within the tool 100.

Referring now to FIG. 3, the tubular element 38 of the handle portion 30 extends to the passage 40 in the housing structure 10. The damper valve 22 within the housing structure 10 is provided with flanges 62 and 64 at its opposite ends. The flange 62 defines a land 66 which has a width slightly greater than the width of the passage 40. The diameter of the flange 62 is only slightly less than the interior diameter of the cylindrical housing structure 10. Thus, a small clearance exists between the flange 62 and the housing structure 10. The flange 64 has a diameter less than that of the flange 62 whereby an annular passage exists between the flange 64 and the housing structure 10.

The damper valve 22 is retained between a stop 68 within the housing structure 10 and a stop 70 extending outwardly from piston 12. When so positioned by the stops 68 and 70 and with piston 12 in the "home" position, the damper valve 22 is in an open position in which the passage 40 is substantially unobstructed by the damper valve 22 so that the damper chamber communicates with the hydraulic fluid-containing chamber of the tubular element 38. Additionally, the bleed screw 28 projects within the space between the flanges 62 and 64.

The flange 62 also includes at least one opening 72 extending parallel to the longitudinal axis of the housing structure 10. The purpose of the opening 72 is to eliminate any vacuum between the flange 62 and the cup seal 24 which might interfere with movement of the damper valve 22.

When the trigger structure 44 is actuated to close the two-position valve 54 as previously described, the resultant increase in pressure of the hydraulic fluid within the tool 100 causes fluid to flow through the annular passage defined by the flange 64 to move the cup seal 26, and hence the piston 12, in a direction away from the swage anvil 18 and to compress the biasing member 20. At the same time, the pressure drop across the flange 64 creates a viscosity drag force which moves the damper valve 22 in the direction of piston movement. As the damper valve 22 continues to so move, the land 66 of its flange 62 increasingly covers the passage 40, until the land 66 substantially restricts the flow of hydraulic fluid through the passage 40. The piston 12 moves until it reaches a rearward position, where the piston 12 is prevented from further movement by stops 74 provided within the interior of the housing structure 10. As this is occurring, the movement of damper valve 22 is arrested as the flange 62 engages the projecting end of the bleed screw 28. In this closed position, the flange 62 substantially covers the passage 40 so that a small flow path exists between the passage 40 and opposite sides of the flange 62 because of the limited clearance between the flange 62 and the housing structure 10.

Following release of the trigger structure 44 and opening of the flow control valve 54, the pressurization of the hydraulic fluid by the pressure-control mechanism 36 is discontinued because the air cylinder 32 no longer is being supplied with pressurized air. The compressed biasing member 20 therefore is able to relax so as to force the piston 12 (and the cup seal 26) towards the swage anvil 18 until it reaches its "home" position. When such movement begins, the land 66 is covering the passage 40 thereby sparing the tool 10 from the shock of rapid hydraulic fluid flow reversal. The movement of the piston 12 towards the swage anvil 18 results in the damper valve 22 displacement through member 70 causing the passage 40 to increase thereby producing a speedy return of piston 12 to its "home" position. Additionally, when the damper valve 22 engages the element 68, the piston 12 is prevented from being propelled beyond its "home" position by the force of the biasing member 20.

The return of trigger structure 44 to its original position following release occurs not only as a result of the release of potential energy from the bent resilient arm portion 50, but also by the force of the air supply on the bottom of flow control valve 54 which returns the valve to its open position. As the valve opens, it moves the arm portion 50 upwardly in the channel 52.

The foregoing detailed description of the preferred embodiments of this invention has been provided for the purposes of illustration and description. It is not intended to be exhaustive or to limit the invention to the precise embodiments disclosed. Many modifications and variations will be apparent to practitioners skilled in this art. The embodiments were chosen and described in order to best explain the principles of the invention and its practical application, thereby enabling others skilled in the art to understand the invention for various embodiments and with various modifications as are suited to the particular use contemplated. It is intended that the scope of the invention be defined by the following claims and their equivalents.

What is claimed is:

1. A swage fastening tool for setting a fastener including a pin and a collar, said swage fastening tool comprising:

(A) a piston-cylinder assembly comprising:

(i) a housing structure having a housing chamber positioned intermediate forward and aft ends of said housing structure extending along an axial direction, a forwardly opening cylindrical cavity coaxially aligned with the housing chamber, and a passage extending radially through said housing structure;

(ii) a swaging assembly disposed in said forwardly opening cylindrical cavity, said swaging assembly including a jaw assembly constructed and arranged to grip and pull a pull portion of the pin and further including a swage anvil having a swage cavity constructed and arranged to engage and swage the collar radially inwardly onto the pin in response to a relative axial pull force between said jaw assembly and said swage anvil;

(iii) a reciprocally movable piston supported in said housing chamber to be slidable along the axial direction between a forward home position and a rearward position, said piston being operatively connected to said swaging assembly so that slidable movement of said piston towards the rearward position applies the relative axial pull force between said jaw assembly and said swage anvil;

(iv) a biasing member to urge said piston from the rearward position towards the forward home position;

(v) a damper assembly having a damper chamber disposed in said housing chamber, said damper chamber being in communication with said passage and containing hydraulic fluid; and (vi) a slidable damper valve accommodated in said damper chamber and movable between a passage open position in which said passage is substantially unobstructed by said damper valve and a passage close position in which said passage is substantially covered by said damper valve to substantially restrict the flow of the hydraulic fluid through said passage; and (B) an actuator assembly comprising:

(i) a trigger housing;

(ii) a pressure-control-mechanism-receiving housing having a hydraulic fluid-containing chamber filled with the hydraulic fluid and in communication with said damper chamber via said passage;

(iii) a trigger structure partially accommodated in said trigger housing; and (iv) a pressure-control mechanism operatively connected to said trigger structure and movable relative to said pressure-control-mechanism-receiving housing, wherein said trigger structure is operatively associated with said pressure-control mechanism so that (a) actuation of said trigger structure moves said pressure-control mechanism to pressurize the hydraulic fluid in said hydraulic fluid-containing chamber and thereby pass the hydraulic fluid through said passage and into said damper chamber so that the hydraulic fluid slides said piston rearward from the forward home position to the rearward position against an urging force of said biasing member and so that the hydraulic fluid slides said damper valve from the passage open position to the passage closed position, and (b) de-actuation of said trigger structure moves said pressure-control mechanism to depressurize the hydraulic fluid in said hydraulic fluid-containing chamber and permit the urging force of said biasing member to return said piston from the rearward position to the forward home position, returning movement of said piston toward the forward home position being initially regulated by return movement of said damper valve from the passage closed position to the passage open position.

2. A swage fastening tool according to claim 1, wherein said damper valve is retained when in the passage open position between a forward stationary stop and an aft movable stop, and wherein said aft movable stop is associated with said piston to move along the axial direction in tandem with the slidable movement of said piston when said trigger structure is actuated.

3. A swage fastening tool according to claim 2, wherein said damper valve is operatively associated with said aft movable stop to regulate forward movement of said piston from the rearward position to the home position upon de-actuation of said trigger structure.

4. A swage fastening tool according to claim 3, wherein said damper chamber and said damper valve are contained within said housing structure in surrounding coaxial relationship with said piston.

5. A swage fastening tool according to claim 4, wherein:

said damper valve has forward and aft annular flanges extending radially and having respective distal ends spaced from an inner surface of said housing structure by respective forward and aft clearances, said forward flange having an opening formed therethrough;

actuation of said trigger structure imparts a pressure drop across said aft flange to create a viscosity drag force from pressurized hydraulic fluid flowing through said aft clearance which moves said damper valve from the open position towards the closed position; and said forward flange substantially restricts the flow of the hydraulic fluid through said passage when said damper valve is in the closed position.

6. A swage fastening tool according to claim 1, wherein said damper chamber and said damper valve are contained within said housing structure in surrounding coaxial relationship with said piston.

7. A swage fastening tool according to claim 6, wherein:

said damper valve has forward and aft annular flanges extending radially and having respective distal ends spaced from an inner surface of said housing structure by respective forward and aft clearances, said forward flange having an opening formed therethrough;

actuation of said trigger structure imparts a pressure drop across said aft flange to create a viscosity drag force from pressurized hydraulic fluid flowing through said aft clearance which moves said damper valve from the open position towards the closed position; and said forward flange substantially restricts the flow of the hydraulic fluid through said passage when said damper valve is in the closed position.

8. A swage fastening tool according to claim 1, further comprising a bleed screw having an end thereof extending into said damper chamber to restrict rearward axial movement of said damper valve during actuation of said trigger structure.

9. A swage fastening tool according to claim 1, wherein said actuator assembly further comprises:

(A) an air cylinder;

(B) a reciprocally movable piston member slidably supported in said air cylinder and operatively connected to said pressure-control mechanism to pressurize and depressurize said hydraulic fluid-containing chamber in response to reciprocal movement of said piston member; and (C) a two-position valve operatively associated with said trigger structure and said piston member of said actuator assembly to pressurize and depressurize said air cylinder in response to actuation and de-actuation, respectively, of said trigger structure.

10. A swage fastening tool for setting a fastener including a pin and a collar, said swage fastening tool comprising:

(A) a piston-cylinder assembly comprising:

(i) a housing structure having a housing chamber positioned intermediate forward and aft ends of said housing structure extending along an axial direction, a forwardly opening cylindrical cavity coaxially aligned with the housing chamber, and a passage extending radially through said housing structure;

(ii) a swaging assembly disposed in said forwardly opening cylindrical cavity, said swaging assembly including a jaw assembly constructed and arranged to grip and pull a pull portion of the pin and further including a swage anvil having a swage cavity constructed and arranged to engage and swage the collar radially inwardly onto the pin in response to a relative axial pull force between said jaw assembly and said swage anvil;

(iii) a reciprocally movable piston supported in said housing chamber to be slidable along the axial direction between a forward home position and a rearward position, said piston being operatively connected to said swaging assembly so that slidable movement of said piston towards the rearward position applies the relative axial pull force between said jaw assembly and said swage anvil;

(iv) a biasing member to urge said piston from the rearward position towards the forward home position;

(v) a damper assembly having a damper chamber disposed in said housing chamber, said damper chamber being in communication with said passage and containing hydraulic fluid; and (vi) a slidable damper valve accommodated in said damper chamber and movable between a passage open position in which said passage is substantially unobstructed by said damper valve and a passage close position in which said passage is substantially covered by said damper valve to substantially restrict the flow of the hydraulic fluid through said passage; and (B) an actuator assembly comprising:

(i) a trigger housing;

(ii) a pressure-control-mechanism-receiving housing having a hydraulic fluid-containing chamber filled with the hydraulic fluid and in communication with said damper chamber via said passage;

(iii) a trigger structure partially accommodated in said trigger housing, said trigger structure having a self-restoring resilient arm portion; and (iv) a pressure-control mechanism operatively connected to said trigger structure and movable relative to said pressure-control-mechanism-receiving housing, wherein said trigger structure is operatively associated with said pressure-control mechanism so that (a) application of a manual force to said trigger structure flexes said resilient arm portion and moves said pressure-control mechanism to pressurize the hydraulic fluid in said hydraulic fluid-containing chamber and thereby pass the hydraulic fluid through said passage and into said damper chamber so that the hydraulic fluid slides said piston rearward from the forward home position to the rearward position against an urging force of said biasing member and so that the hydraulic fluid slides said damper valve from the passage open position to the passage closed position, and (b) release of the manual force from said trigger structure restores said resilient arm portion and moves said pressure-control mechanism to depressurize the hydraulic fluid in said hydraulic fluid-containing chamber and permit the urging force of said biasing member to return said piston from the rearward position to the forward home position, returning movement of said piston toward the forward home position being initially regulated by return movement of said damper valve from the passage closed position to the passage open position.

11. A swage fastening tool according to claim 10, wherein said damper valve is retained when in the passage open position between a forward stationary stop and an aft movable stop, and wherein said aft movable stop is associated with said piston to move along the axial direction in tandem with the slidable movement of said piston when said trigger structure is actuated.

12. A swage fastening tool according to claim 11, wherein said damper valve is operatively associated with said aft movable stop to regulate forward movement of said piston from the rearward position to the home position upon de-actuation of said trigger structure.

13. A swage fastening tool according to claim 12, wherein said damper chamber and said damper valve are contained within said housing structure in surrounding coaxial relationship with said piston.

14. A swage fastening tool according to claim 13, wherein:

said damper valve has forward and aft annular flanges extending radially and having respective distal ends spaced from an inner surface of said housing structure by respective forward and aft clearances, said forward flange having an opening formed therethrough;

actuation of said trigger structure imparts a pressure drop across said aft flange to create a viscosity drag force from pressurized hydraulic fluid flowing through said aft clearance which moves said damper valve from the open position towards the closed position; and said forward flange substantially restricts the flow of the hydraulic fluid through said passage when said damper valve is in the closed position.

15. A swage fastening tool according to claim 10, wherein said damper chamber and said damper valve are contained within said housing structure in surrounding coaxial relationship with said piston.

16. A swage fastening tool according to claim 15, wherein:

said damper valve has forward and aft annular flanges extending radially and having respective distal ends spaced from an inner surface of said housing structure by respective forward and aft clearances, said forward flange having an opening formed therethrough;

actuation of said trigger structure imparts a pressure drop across said aft flange to create a viscosity drag force from pressurized hydraulic fluid flowing through said aft clearance which moves said damper valve from the open position towards the closed position; and said forward flange substantially restricts the flow of the hydraulic fluid through said passage when said damper valve is in the closed position.

17. A swage fastening tool according to claim 10, further comprising a bleed screw having an end thereof extending into said damper chamber to restrict rearward axial movement of said damper valve during actuation of said trigger structure.

18. A swage fastening tool according to claim 10, wherein said actuator assembly further comprises:

(A) an air cylinder;

(B) a reciprocally movable piston member slidably supported in said air cylinder and operatively connected to said pressure-control mechanism to pressurize and depressurize said hydraulic fluid-containing chamber in response to reciprocal movement of said piston member; and (C) a two-position valve operatively associated with said trigger structure and said piston member of said actuator assembly to pressurize and depressurize said air cylinder in response to actuation and de-actuation, respectively, of said trigger structure.

19. A swage fastening tool according to claim 10, wherein application of the manual force to said trigger structure flexes said resilient arm portion by compressing said resilient arm portion along a length thereof.

20. A swage fastening tool for setting a fastener including a pin and a collar, said swage fastening tool comprising:

(A) a piston-cylinder assembly comprising:

(i) a housing structure having a housing chamber positioned intermediate forward and aft ends of said housing structure extending along an axial direction, a forwardly opening cylindrical cavity coaxially aligned with the housing chamber, and a passage extending radially through said housing structure;

(ii) a swaging assembly disposed in said forwardly opening cylindrical cavity, said swaging assembly including a jaw assembly constructed and arranged to grip and pull a pull portion of the pin and further including a swage anvil having a swage cavity constructed and arranged to engage and swage the collar radially inwardly onto the pin in response to a relative axial pull force between said jaw assembly and said swage anvil;

(iii) a reciprocally movable piston supported in said housing chamber to be slidable along the axial direction between a forward home position and a rearward position, said piston being operatively connected to said swaging assembly so that slidable movement of said piston towards the rearward position applies the relative axial pull force between said jaw assembly and said swage anvil;

(iv) a biasing member to urge said piston from the rearward position towards the forward home position; and (v) a hydraulic-fluid containing chamber in communication with said passage and containing hydraulic fluid; and (B) an actuator assembly comprising:

(i) a trigger housing;

(ii) a pressure-control-mechanism-receiving housing having a hydraulic fluid-containing chamber filled with the hydraulic fluid and in communication with said damper chamber via said passage;

(iii) a trigger structure partially accommodated in said trigger housing, said trigger structure having a self-restoring resilient arm portion; and (iv) a pressure-control mechanism operatively connected to said trigger structure and movable relative to said pressure-control-mechanism-receiving housing, wherein said trigger structure is operatively associated with said pressure-control mechanism so that (a) application of a manual force to said trigger structure compresses said resilient arm portion along a length thereof and moves said pressure-control mechanism to pressurize the hydraulic fluid in said hydraulic fluid-containing chamber of said actuator assembly and thereby pass the hydraulic fluid through said passage and into said hydraulic fluid-containing chamber of said piston-cylinder assembly so that the hydraulic fluid slides said piston rearward from the forward home position to the rearward position against an urging force of said biasing member, and (b) release of the manual force from said trigger structure restores said resilient arm portion and moves said pressure-control mechanism to depressurize the hydraulic fluid in said hydraulic fluid-containing chamber of said actuator assembly and permit the urging force of said biasing member to return said piston from the rearward position to the forward home position.

21. A swage fastening tool according to claim 20, wherein said piston-cylinder assembly further comprises a piston stop positioned to limit the slidable movement of said piston towards said aft end of said housing structure.

22. A swage fastening tool according to claim 20, wherein said actuator assembly further comprises:

(A) an air cylinder;

(B) a reciprocally movable piston member slidably supported in said air cylinder and operatively connected to said pressure-control mechanism to pressurize and depressurize said hydraulic fluid-containing chamber of said actuator assembly in response to reciprocal movement of said piston member; and (C) a two-position valve operatively associated with said trigger structure and said piston member of said actuator assembly to pressurize and depressurize said air cylinder in response to actuation and de-actuation, respectively, of said trigger structure.

* * * * *